US011661778B2

(12) United States Patent
Frede

(10) Patent No.: US 11,661,778 B2
(45) Date of Patent: May 30, 2023

(54) HIGH SPEED OVERHEAD DOOR

(71) Applicant: ASSA ABLOY ENTRANCE SYSTEMS AB, Landskrona (SE)

(72) Inventor: Friedhelm Frede, Lippstadt (DE)

(73) Assignee: Assa Abloy Entrance Systems AB, Landskrona (SE)

( * ) Notice: Subject to any disclaimer, the term of this patent is extended or adjusted under 35 U.S.C. 154(b) by 364 days.

(21) Appl. No.: 16/759,702

(22) PCT Filed: Nov. 5, 2018

(86) PCT No.: PCT/EP2018/080115
§ 371 (c)(1),
(2) Date: Apr. 27, 2020

(87) PCT Pub. No.: WO2019/091896
PCT Pub. Date: May 16, 2019

(65) Prior Publication Data

US 2020/0300014 A1 Sep. 24, 2020

(30) Foreign Application Priority Data

Nov. 8, 2017 (SE) ..... 1730307-4

(51) Int. Cl.
*E05D 15/24* (2006.01)
*E05F 15/60* (2015.01)
*E05D 13/00* (2006.01)

(52) U.S. Cl.
CPC ..... *E05D 15/244* (2013.01); *E05D 13/10* (2013.01); *E05F 15/60* (2015.01);
(Continued)

(58) Field of Classification Search
CPC ..... E05D 15/244; E05D 15/24; E05D 13/10; E05D 13/1215; E05D 2015/225;
(Continued)

(56) References Cited

U.S. PATENT DOCUMENTS 3,094,163 A * 6/1963 Herber ..... E05D 13/145 160/190
4,795,206 A * 1/1989 Adams ..... B60J 5/14 296/100.09

(Continued)

FOREIGN PATENT DOCUMENTS

AU 2007203513 2/2008
CN 1187231 7/1998

(Continued)

OTHER PUBLICATIONS

International Search Report and Written Opinion mailed in PCT/EP2018/080115 dated Feb. 14, 2019.
Swedish Search Report mailed in 1730307-4 dated May 22, 2018.

*Primary Examiner* — William L Miller
(74) *Attorney, Agent, or Firm* — Wissing Miller LLP

(57) ABSTRACT

The invention relates to an overhead door for covering a door opening comprising a door blade (11) with a plurality of panels (17), said door blade (11) being movable between a vertical, closed position and a horizontal, opened or overhead position within a side frame (12) comprising double-sided a vertical track (13) and a horizontal track (14), connected by a connecting portion (15), respectively, and with a belt (20) or a chain associated with one side each of the said side frame (12) to lift the panels (17) from said vertical position to said horizontal position. To develop the stated overhead door in a way that the advantages of a high speed rollup door and an overhead door are combined, to offer an overhead door with a low space requirement, low maintenance requirements and a high speed closing possibility, the stated overhead door comprises driving means (27) for simultaneously driving a plurality of said panels (17).

17 Claims, 9 Drawing Sheets

(52) U.S. Cl.
CPC ... *E05Y 2201/652* (2013.01); *E05Y 2201/656* (2013.01); *E05Y 2900/132* (2013.01)

(58) Field of Classification Search
CPC ..... E05Y 2201/652; E05Y 2201/656; E05Y 2900/132; E05Y 2900/146; E05F 15/60; E05F 15/681
USPC .... 160/193, 188, 189, 201, 231.1, 230, 133, 160/32
See application file for complete search history.

(56) References Cited

U.S. PATENT DOCUMENTS 4,887,658 A * 12/1989 Cloutier ..... E06B 9/62 160/190
5,277,240 A * 1/1994 Epema ..... E05D 15/24 160/209
5,722,476 A 3/1998 Gomez
5,738,161 A 4/1998 Martin
6,019,156 A * 2/2000 Wagner ..... E06B 9/13 160/310
8,935,883 B2 * 1/2015 Coubray ..... E05F 15/67 160/188
2002/0129907 A1 * 9/2002 Schutz ..... E05F 15/686 160/188
2005/0217806 A1 10/2005 Bruno
2007/0000622 A1 * 1/2007 Reed ..... E05F 15/40 160/188
2007/0200519 A1 * 8/2007 Murphy ..... E05F 15/686 318/280
2011/0271596 A1 * 11/2011 Schaaf ..... E05F 15/668 49/358
2012/0180959 A1 7/2012 Gunton
2017/0067285 A1 * 3/2017 Lambridis ..... E06B 9/581
2020/0126392 A1 * 4/2020 Witkowski ..... G08B 21/182
2021/0310294 A1 * 10/2021 Lindley ..... E05F 15/686
2021/0404239 A1 * 12/2021 Hall ..... E05F 15/41

FOREIGN PATENT DOCUMENTS

DE 9005127 7/1990
DE 19741410 6/1999
EP 0523630 1/1993
EP 1076144 2/2001
EP 1527248 5/2005
EP 1601853 12/2005
EP 2304154 4/2011
JP 0538221 5/1993
JP 0542591 6/1993
JP 0782966 3/1995
JP 2887077 1/1996
JP 11229728 8/1999
WO 2004018820 3/2004
WO 2004076795 9/2004
WO 2005100730 10/2005
WO 2009143853 12/2009
WO 2009148460 12/2009
WO WO-2014114528 A1 * 7/2014 ..... E06B 9/17
WO WO-2015144729 A1 * 10/2015 ..... E06B 9/15
WO WO-2021180831 A * 9/2021

* cited by examiner

HIGH SPEED OVERHEAD DOOR

CROSS REFERENCE TO RELATED APPLICATIONS

This application is a 371 of PCT/EP2018/080115 filed on Nov. 5, 2018, published on May 16, 2019 under publication number WO 2019/091896, which claims priority benefits from Swedish Patent Application No. 1730307-4 filed on Nov. 8, 2017, the disclosure of which is incorporated herein by reference.

BACKGROUND

Technical Field

The invention relates to an overhead door for covering a door opening comprising a door blade with a plurality of panels, said door blade being movable between a vertical, closed position and a horizontal, opened or overhead position within a side frame comprising double-sided a vertical track and a horizontal track, connected by a connecting portion, respectively, and with a belt or a chain associated with one side each of the said side frame to lift the panels from said vertical position to said horizontal position.

In this context, the indication horizontal track is a general definition, used for a track leading the door blade in a horizontal, opened or overhead position. This horizontal track runs in an upper part of the overhead door and does not have to be horizontal necessarily, but can be transversely as well. Thus, the angle between the not necessarily vertically extending vertical track and the not necessarily horizontally extending horizontal track can deviate from a right angle.

Description of Related Art

Exemplarily an overhead door is known from WO 2005/100730 A1. According to this document an overhead door is provided with a movable door element, comprising a flexible steel door blade with a rounded rectangular or rounded trapezoidal profile and with opposed side regions, which ride in a track when travelling between an opened and a closed position. The track includes a vertical and a horizontal part, as well as a link portion, operatively connected there between. Carriages including rollers are connected to the door blade to facilitate smooth running of the door blade in the tracks.

Further, sectional overhead doors are known, presenting door blades, providing a plurality of panels, connected by rigid hinges, placed on both ends of the panels and partly in the middle of the panels. Usually a lifting device, for example a steel rope, a belt or a chain is fixed at the bottom of the door blade and pulls up the door blade, thus, leading the operating forces from the bottom of the door blade to the top. This leads to the following disadvantages:

(1) rigid hinges are required to push the panels into the open, horizontal position; the forces which operate on the hinges require maintenance, like lubrication, and exchange of the same;

(2) if the bottom panel is damaged, for example caused by a crash (exemplarily a forklift truck drives into the door blade), the lifting devices can't work any longer;

(3) the rigid hinges are often twisted after a crash which makes the movement of the door blade impossible; repairing time and costs are quite high.

Another disadvantage of the known overhead doors is that usually at minimum one set of rollers is used to guide the door blade in the tracks. This rollers move all the way over a complete operation process, thus creating noises and wear.

Closing an overhead door fast requires a force to push or pull the door blade from the horizontal position into the vertical position. Known high speed overhead door systems for instance, use pull down systems to close a door blade. The hinges load inverse and the panels follow with inertia. This causes a discontinuous movement of panels during the acceleration. Alternatively, overhead doors were closed by gravity or press down devices, like spring starters, thus, reducing the operation speed of the closing procedure compared to the opening procedure.

Known high speed doors are usually rollup doors, exemplarily known from EP 2 304 154 A1. This rollup door provides a door leaf comprising a plurality of ridged lamellae and a flexible strip as a lifting device for selectively lifting and lowering the door leaf. Also, rollup doors are known with a curtain made of soft plastic, like PVC. By rolling up the door leaf the diameter of the resulting top roll increases strongly. Further, as energy saving becomes more important at industrial high speed doors, to optimize the thermal insulation and to increase the wind stability, the thickness of the door leaf increases more. Therefore a big spatial need over a lintel is required. Often this does not fit to applications with limited space over the lintel. To reduce the required spatial need over the lintel significant, overhead doors are used instead of rollup doors.

BRIEF SUMMARY

Having regard to the state of art, the invention's purpose is to develop the stated overhead door in a way that the advantages of a high speed rollup door and the advantages of an overhead door are combined, to offer an overhead door with a low space requirement above, low maintenance requirements and a high speed opening and closing possibility.

The technical problem outlined above is solved by an overhead door as stated above, comprising driving means for simultaneously driving a plurality of said panels.

In this way, during the closing procedure, a plurality of panels can be accelerated simultaneously by the driving means, thus, leading to a smooth start of the closing procedure and facilitating a high closing speed.

In a preferred embodiment of the invention the driving means comprise a conveyor belt system adjacent to the horizontal track. The horizontal track can run transverse or perpendicular to the vertical track. Said conveyor belt system is at least in said horizontal position of said door blade in engagement at least partially with the door blade. In particular, said conveyor belt system is at least in said horizontal position of said door blade in engagement at least partially with the said belt, being fixed to said door blade.

Said conveyor belt system can transport said door blade. Instead of a conveyor belt system said driving means can comprise a flexible toothed rack or a timing belt.

In a preferred embodiment of the invention said panels have a height from 100 mm to 350 mm, preferably from 150 mm to 300 mm, particularly preferably from 200 mm to 250 mm. The reduced height of the panels enables the overhead door to lift fast, especially around a curved shaped guideway.

As a further improvement of the solution said panels are guided sliding in said side frame. Thus, no rollers are required for vertical guiding. Therefore, the creating of noises and wear is reduced.

In another preferred embodiment, the overhead door is characterized by end pieces. Preferably two of said end pieces are assigned to one of said panels each. Thereby one of said end pieces is fitted in longitudinal direction to a first end of a panel. Another of said end pieces is fitted in longitudinal direction to a second end of a panel. Said end pieces fitted to the first end of said panels and said end pieces fitted to the second end of said panels are fixed to one belt, respectively. In particular said belt is constructed as flexible, flat belt. Said belt can be constructed as a flexible cord or as a flexible metal strip. In particular, said belt can be constructed as a rigid belt, cord or metal strip, being flexible enough to be guided around a curved shaped guideway. Said belt can work as a flexible hinge. The use of a belt as flexible hinge limits the damage after a crash, as compared to the use of ridged hinges to connect panels. Further, said belt can work as lifting device, to lift the door blade. As the end pieces of the panels are fixed to the belt each, even if the bottom panel is damaged, the opening and closing procedure can work properly. Also, by using a belt no maintenance would be required on hinges. Further, by using a belt, panels or the position of a panel can be changed fast and more easily, compared to the use of hinges to connect panels.

As a further improvement of the solution at an upper end of said belt additional end pieces can be fixed without being fitted to said panels. This enables said belt to be pulled in an accurate radius around a curved connection part, connecting said vertical track and said horizontal track by using said guideway. In a preferred embodiment of the invention two or three additional end pieces can be fixed without being fitted to said panels.

As a further improvement of the solution said conveyor belt system is powered by a drum axis. Said drum axis can have a rotation axis. Said drum axis can be turned around said rotation axis. Depending on the direction said drum axis is turned around said rotation axis, said conveyor belt system can be driven in one direction or in another direction. In particular, a transmission element can be used to couple said conveyor belt system with said drum axis.

In another preferred embodiment said drum axis extends in parallel to said panels. Preferably said drum axis is arranged in a transition region between said vertical tracks and said horizontal tracks. Preferably said drum axis is carried by a support means. The support means can be used to couple said drum axis to a motor, which can power said drum axis. When powering said drum axis, said drum axis can be turned around a rotation axis. In particular, said rotation axis of said drum axis can run lengthwise to the spreading direction of said drum axis.

In another preferred embodiment, the overhead door is characterized by at least one disc. Preferably said disc is assigned to said drum axis. In particular two discs are assigned in axial direction to a first end and/or to a second end of said drum axis, respectively. In other words, lengthwise to the spreading direction of said drum axis, two discs are arranged on a first side of the drum axis and two discs are arranged on a second side of the drum axis, respectively. Preferably two discs are arranged to a first end and/or a second end of a drum supported to the drum axis, respectively. In particular, said disc can rotate free on said drum. Further said conveyor belt system can be coupled to said disc by using a transmission element.

In another preferred embodiment, the overhead door is characterized by at least one gearwheel. Preferably said gearwheel is assigned to said drum axis. In particular two gearwheels are assigned in axial direction to a first end and/or to a second end of said drum axis, respectively. Further said conveyor belt system can be coupled to said disc by using a transmission element. Said gearwheel can be used as transmission drive between said drum axis and said conveyor belt system. In particular said gearwheel can be used to connect said drum axis with one cogwheel or one wheel of the conveyor belt system.

In another preferred embodiment, the overhead door is characterized by at least one blade spring or tension spring or weight. Preferably said spring or weight is assigned to said drum axis. In particular two or more springs are assigned in axial direction to a first end and to a second end of said drum axis, respectively. Said springs can be connected to a drum shaft, provided double-sided of said drum axis. Said drum shaft can be provided by said side frames. Said blade springs can be used to support a motor, which powers said drum axis. Further said blade springs can be used to balance said door blade.

As a further improvement of the solution said conveyor belt system comprises one, preferably two cogwheels, a conveyor belt, a chain and/or a plurality of wheels. Preferably said conveyor belt system comprises two cogwheels. A first cogwheel and a second cogwheel can be arranged on both sides of the conveyor belt system, respectively, averted from each other. Said first cogwheel can be arranged on that side of said conveyor belt system adjacent to said disc. Said second cogwheel can be arranged on that side of said conveyor belt system averted from said disc. Said conveyor belt can extend lengthwise along said conveyor belt system. In particular said conveyor belt can circulate said cogwheels or said plurality of wheels. Alternatively said conveyor belt can circulate said cogwheels and said plurality of wheels. By doing so, said cogwheels or said wheels guide and stabilize said conveyor belt.

In another preferred embodiment, the overhead door is characterized by a bracket. Said bracket couples said conveyor belt system with an upper end of said belt. In particular said bracket couples said conveyor belt of said conveyor belt system with an upper end of said belt. By doing so, when the conveyor belt system is actuated, said conveyor belt moves. In accordance with the movement of said conveyor belt said bracket moves and simultaneously said belt is moved. In this way, the door blade can be moved from a vertical to a horizontal, opened or overhead position, or the other way around, depending on the direction of movement of the conveyor belt. As a further improvement of the solution said door blade is guided above said conveyor belt of said conveyor belt system.

In another preferred embodiment, the overhead door is characterized by a transmission element. Said transmission element couples said conveyor belt system with said drum axis or said gearwheel. In particular said transmission element couples said cogwheel or any of said other wheels of said conveyor belt system with said drum axis or said gearwheel. Especially said transmission element couples said cogwheel and any of said other wheels of said conveyor belt system with said drum axis or said gearwheel. By coupling said conveyor belt system with said drum axis or said gearwheel by using said transmission element, said drum axis can power the conveyor belt system by turning around its rotation axis. Said transmission element can be constructed as a transfer belt. Said gearwheel can be coupled to said drum axis.

In another preferred embodiment, the overhead door is characterized by a motor. Preferably said motor is coupled to a gear box. Said motor is coupled to said drum axis. Alternatively said motor is coupled to said cogwheels or any of said other wheels of the conveyor belt system. The motor can be used to power the drum axis. Also, the motor can be used to power the conveyor belt system.

As a further improvement of the solution said connection portion comprises a guideway with a disc, at least one wheel, a support belt and/or a curve guiding. Said connecting portion connects said vertical track and said horizontal track.

The above described driving attachment allows transferring the operating forces to all of said panels, in particular from said panels in a horizontal position to said panels in a vertical position. Further, this kind of driving attachment is largely maintenance-free.

BRIEF DESCRIPTION OF THE DRAWINGS

Hereinafter preferred embodiments of the invention will be described with reference to the attached figures. The figures show.

DETAILED DESCRIPTION

Figure 1:
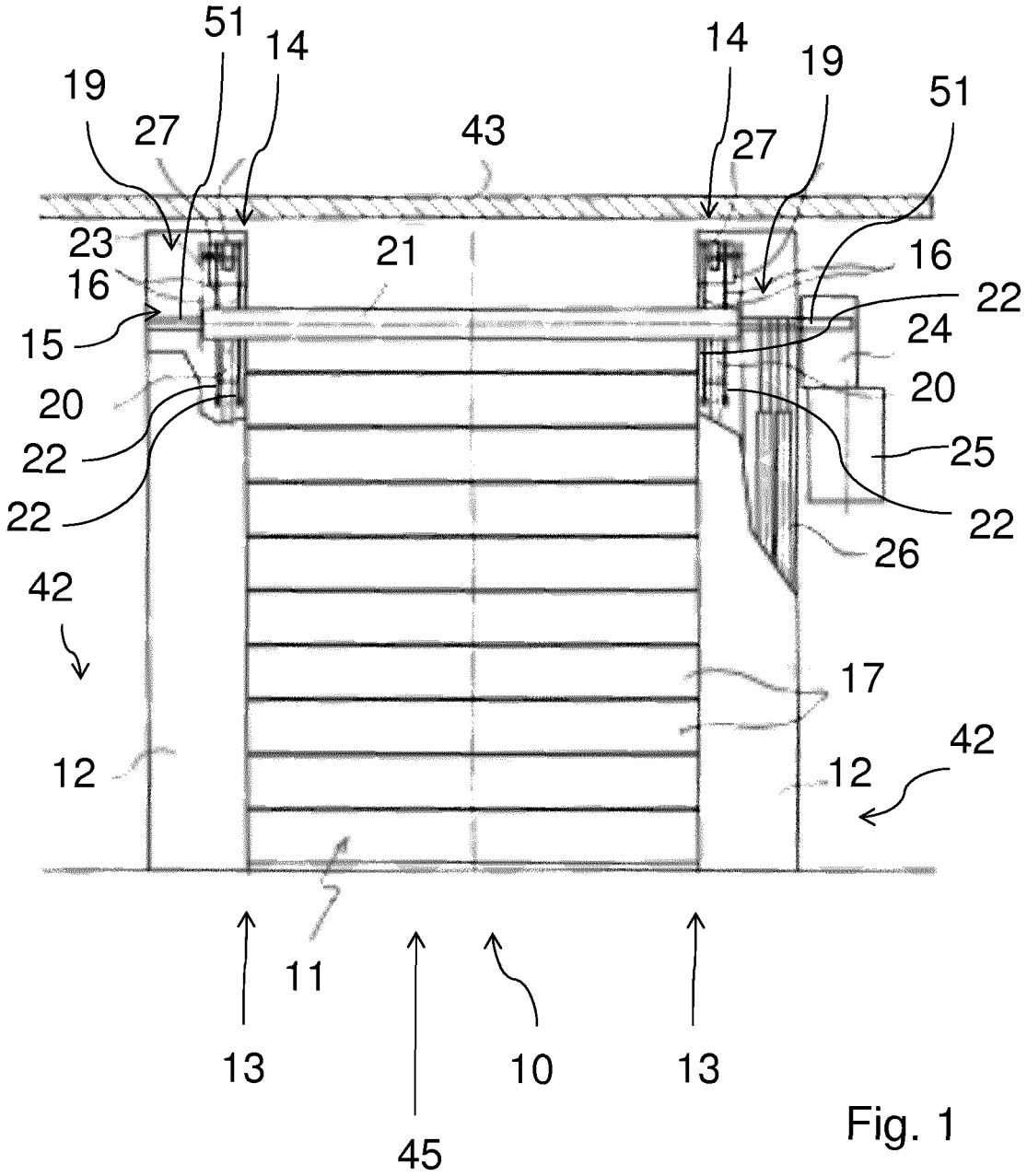
FIG. 1 a schematic rear view of a first embodiment of an overhead door with the features of the invention in a closed state, FIG. 2 a schematic sectional top view of the overhead door in accordance with FIG. 1, presenting the overhead door in a closed state, FIG. 3 a schematic sectional view of the overhead door in accordance with FIG. 1, presenting the overhead door in a closed state, FIG. 4 a schematic sectional view of the overhead door in accordance with FIG. 1, presenting the overhead door in an opened state, FIG. 5 a schematic sectional view of a second embodiment of the overhead door with the features of the invention in an opened state, FIG. 6 a schematic section of a third embodiment of an overhead door with the features of the invention in a closed state, FIG. 7 a schematic section of a fourth embodiment of an overhead door with the features of the invention in a closed state, FIG. 8 a schematic section of a fifth embodiment of an overhead door with the features of the invention in a closed state, and FIG. 9 a schematic section of another embodiment of an overhead door with the features of the invention in a closed state.

FIG. 1 shows a schematic rear view of a first embodiment of an overhead door 10 with the features of the invention in a closed state. The overhead door 10 has a door blade 11 for covering a door opening 45, running in a side frame 12. In the shown example, the door blade 11 covers a door opening surrounded double-sided by a wall 42 and by a ceiling 43 above. The side frame 12 has double-sided a vertical track 13, provided as a guiding element on the left and on the right side of the door blade 11, respectively. Further, the side frame 12 has double-sided a horizontal track 14. The horizontal track 14 runs transversely to the vertical track 13, extending rearward to the door blade 11 in front view. In this example the horizontal track 14 runs perpendicular to the vertical track 13. A connecting portion 15 with a curved shape connects the vertical track 13 and the horizontal track 14, providing a guideway 16. The horizontal tracks 14 of the side frame 12 are fixed at a rear side 46 (see FIG. 4) below the ceiling 43. At a front side the horizontal tracks 14 are fixed at the vertical tracks 13 of the side frames 12, respectively.

The door blade 11 comprises a plurality of panels 17. The shown door blade 11 comprises ten panels 17, consisting of a rigid material. To provide a better overview, reference signs are only attached to two panels 17. Each of the panels 17 has a height of two hundred millimeters. Further, each of the panels 17 provides two end pieces 18, one end peace 18 of a panel 17 is shown in FIGS. 2 to 9. To provide a better overview, reference signs are only attached to few end pieces 18 in FIGS. 2 to 9. The end pieces 18 are arranged lengthwise on both sides of each panel 17, respectively. The end pieces 18 of the panels 17 run in vertical direction in slots 19, provided double-sided on the vertical track 13 of the side frame 12.

The panels 17 are connected to a belt 20. For doing so, one belt 20 connects the end pieces 18 of the panels 17 on both sides of the panels 17, respectively. Thereby the belt 20 works as a lifting device and as a hinge between the panels 17. The belt 20 runs in vertical direction in the slot 19 on both sides of the vertical track 13 of the side frame 12, respectively. In the shown example the belts 20 are constructed as flexible, flat belts 20.

Adjacent to the connecting portion 15, a drum 21 is arranged. The drum 21 extends horizontally between both sides of the side frame 12. The drum 21 is mounted rotatable on a drum axis 51. The drum axis 51 is mounted rotatable on support means 49, not shown in this figure. Double-sided to the drum 21 two discs 22 are arranged. In the pictured execution example, the discs 22 represent at the same time the guideway 16 of the connecting portion 15 between the vertical track 13 and the horizontal track 14. By using two discs 22 as guideway, the load of the connection between the panels 17 and the corresponding end pieces 18 can be reduced. Alternatively, instead of two discs 22 a single broad disc could be used as guideway. A transmission element 23 is provided, coupling the drum axis 51 and the horizontal track 14 on both sides of the side frame 12, respectively, shown detail in FIGS. 3 and 4.

Further, adjacent to the drum axis 51 a gear box 24 and a motor 25 are arranged. Further, support means 49 are arranged adjacent to the drum axis 51 for supporting the same. In the shown example, the gear box 24 and the motor 25 are arranged on the right side of the drum axis 51. The gear box 24 is connected to the motor 25. The motor 25 is coupled via the gear box 24 to the drum axis 51. The gear box 24 and the motor 25 are used to power the drum axis 51. Double-sided of the drum axis 51 springs 26 are arranged. In the shown example the springs 26 are designed as blade springs 26. Two blade springs 26 are arranged on each side of the drum axis 51, respectively. In other words, lengthwise to the axial direction of said drum axis 51, two blade springs 26 are arranged on a first side of the drum axis 51 and two blade springs 26 are arranged on a second side of the drum axis 51. The blade springs 26 extend in vertical direction, parallel to the vertical track 13 in the side frame 12, respectively. The blade springs 26 support the motor 25.

Figure 2:
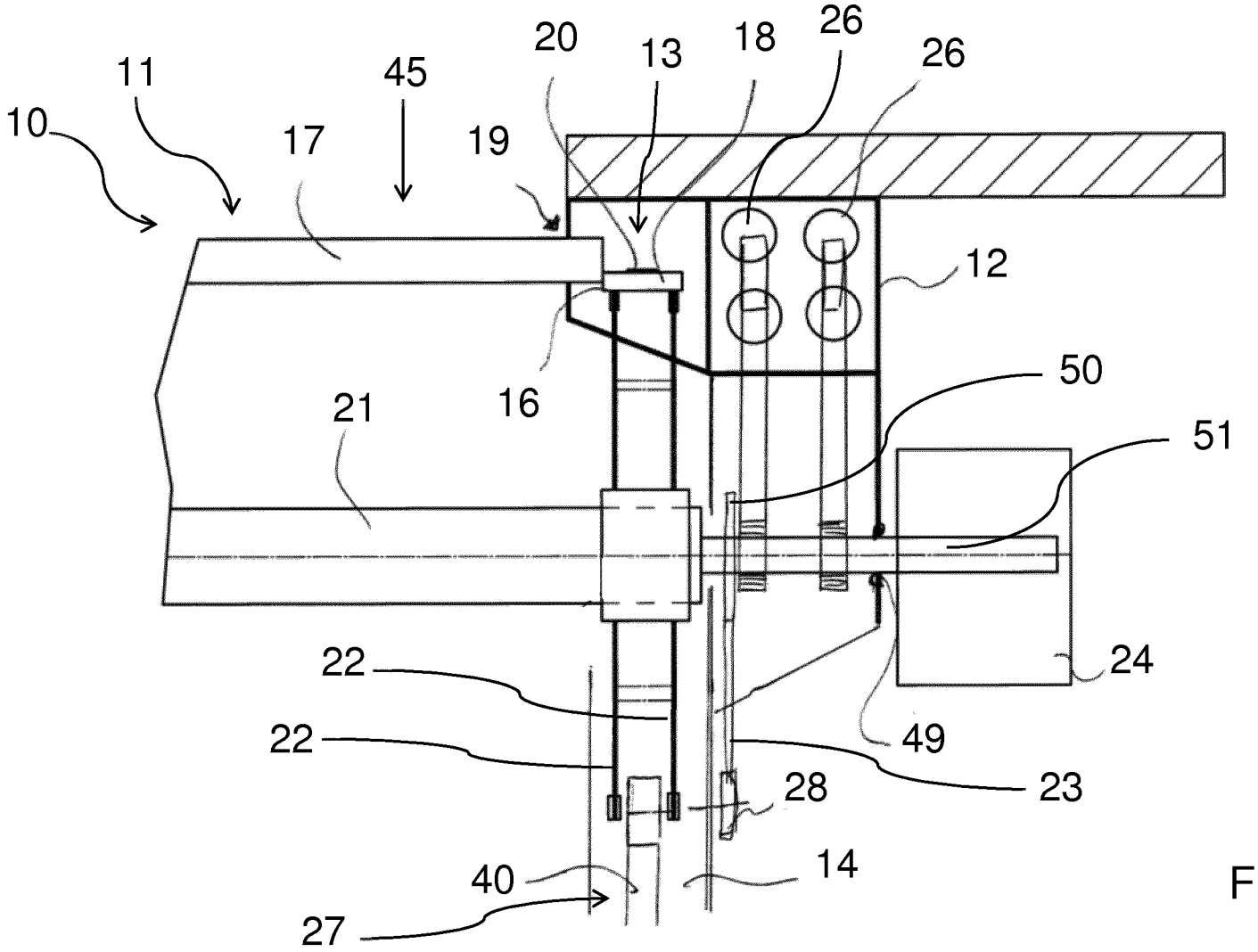

FIG. 2 shows a schematic sectional top view of the overhead door 10 in accordance with FIG. 1, presenting the overhead door 10 in a closed state. The door opening 45 is completely closed by the door blade 11. Thereby the door blade 11 is located between the vertical tracks 13 of the side frame 12. The vertical track 13 and the horizontal track 14 are connected by a guideway, in this example represented by the two discs 22.

In this top view, only a single panel 17 and a single end piece 18 are visible. The end pieces 18 of the panels 17 run in vertical direction in the slot 19. The panels 17 are connected to the belt 20.

The drum axis 51 is mounted rotatable on support means 49. Adjacent to the drum axis 51 a gear box 24, a motor 25, which is not shown in this figure, and two blade springs 26 are arranged.

The horizontal track 14 has a conveyor belt system 27. The conveyor belt system 27 extends lengthwise along the horizontal track 14. A second conveyor belt system 27 is provided on the right side of the side frame 12, not visible in this view. The conveyor belt system 27 has a conveyor belt 40. In the pictured execution example the conveyor belt 40 is constructed as a timing belt. Alternatively the conveyor belt 40 can be constructed as a chain. Further, the conveyor belt system 27 has a first cogwheel 28. The first cogwheel 28 and the drum axis 51 are coupled by the transmission element 23 on both sides of the side frame 12, respectively. Coupling the first cogwheel 28 and the drum axis 51, the transmission element 23 circulates the cogwheel 28 and a wheel disc 50 of the drum axis 51.

Figure 3:
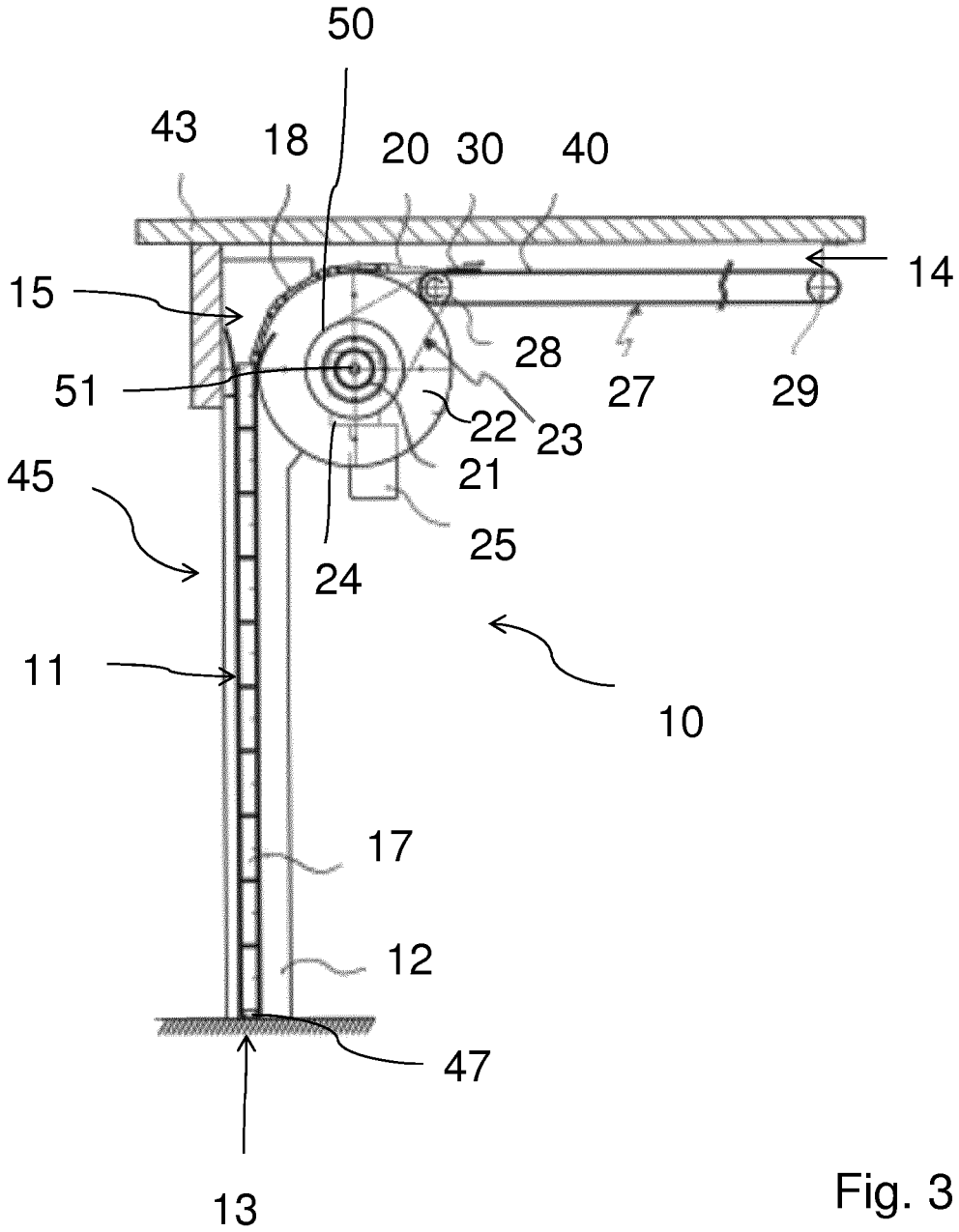

FIG. 3 shows a schematic sectional view of the overhead door 10 in accordance with FIG. 1, presenting the overhead door 10 in a closed state. In this view, only the left side of the side frame 12 is visible. The door opening 45 is completely closed by the door blade 11. Thereby the door blade 11 is located between the vertical tracks 13 of the side frame 12. The vertical track 13 and the horizontal track 14 are connected by a guideway, in this example represented by the discs 22, of which only one disc 22 is visible in this figure.

A bottom sealing 47 is provided on that panel 17 being located adjacent to the ground. To provide a better overview, the panels 17 are shown without end pieces 18. At the upper end of the belt 20 additional end pieces 18 are fixed without being fitted to panels 17. In the shown example, three additional end pieces 18 are fixed at the upper end of the belt 20, without being fitted to panels 17. This enables the belt 20 to be pulled in an accurate radius around the curved connection portion 15 as the discs 22 are used as guideway.

The conveyor belt system 27 extends lengthwise along the horizontal track 14. The conveyor belt system 27 has a conveyor belt 40, a first cogwheel 28 and a second cogwheel 29. The first cogwheel 28 and the second cogwheel 29 are arranged on both sides of the conveyor belt system 27, respectively, averted from each other. The first cogwheel 28 is arranged on that side of the conveyor belt system 27 adjacent to the drum axis 51. The second cogwheel 29 is arranged on that side of the conveyor belt system 27 averted from the drum axis 51. The conveyor belt 40 extends lengthwise along the conveyor belt system 27, circulating the cogwheels 28, 29.

The first cogwheel 28 and the drum axis 51 are coupled by the transmission element 23 on both sides of the side frame 12, respectively.

On an upper end of the belt 20 a bracket 30 is provided. The bracket 30 is connected with the conveyor belt 40 of the conveyor belt system 27. By doing so, the belt 20 is coupled with the conveyor belt system 27. In the closed state of the overhead door 10, the bracket 30 is located on the conveyor belt 40 of the conveyor belt system 27 adjacent to the first cogwheel 28.

Figure 4:
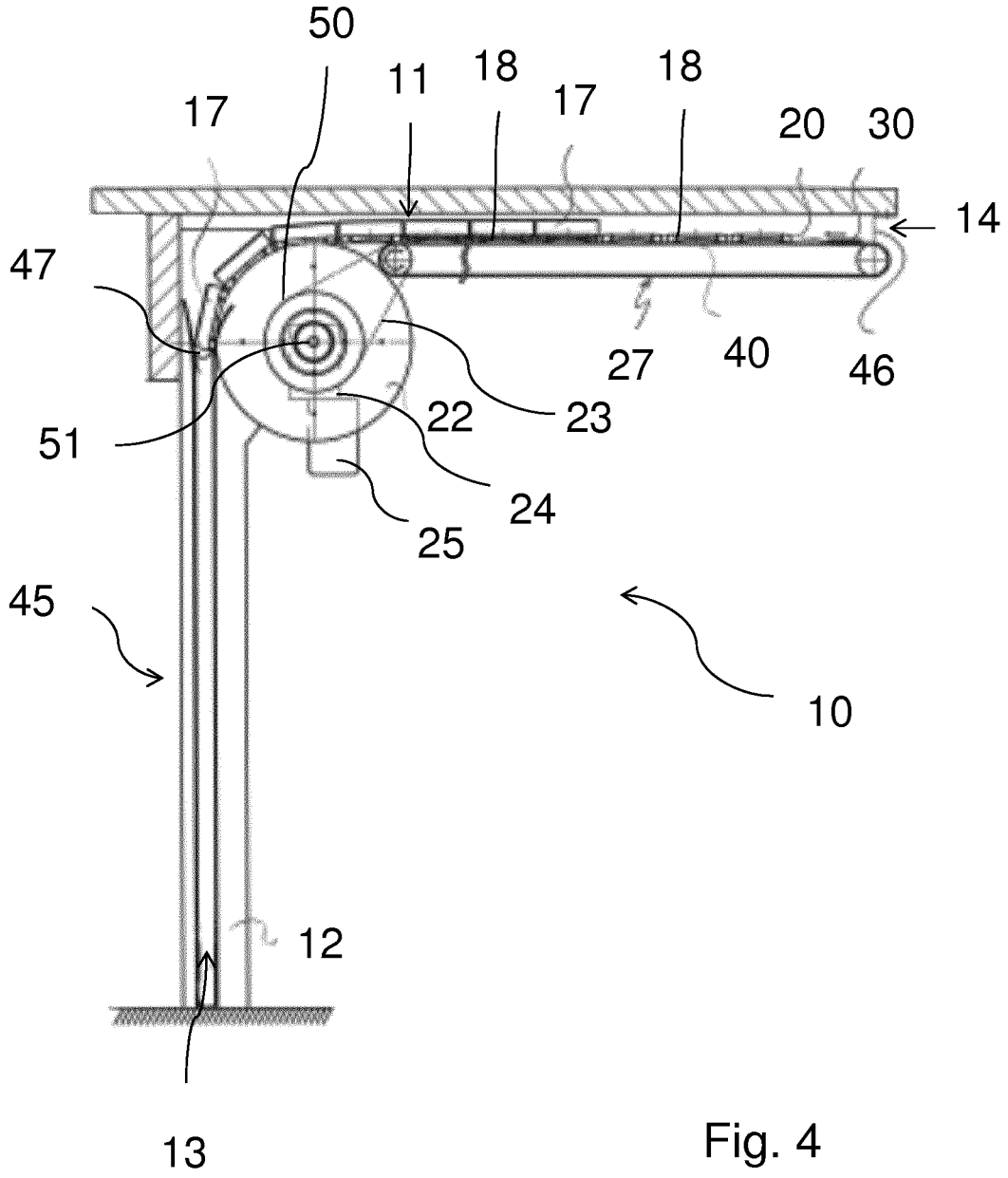

FIG. 4 shows a schematic sectional view of the overhead door 10 in accordance with FIG. 1, presenting the overhead door 10 in an opened state. In this view, only the left side of the side frame 12 is visible. The door opening 45 is completely opened. The door blade 11 is moved to the horizontal track 14 of the side frame 12. To provide a better overview, only seven of the ten panels 17 are shown. The vertical track 13 and the horizontal track 14 are connected by a guideway, represented by the discs 22, of which only one disc 22 is visible in this figure. At the upper end of the belt 20 three additional end pieces 18 are fixed without being fitted to panels 17. Depending on the radius of the disc 22 and the height of the panels 17, more or less than three additional end pieces 18, not being fitted to panels 17, are possible.

The first cogwheel 28 and the drum axis 51 are coupled by the transmission element 23 on both sides of the side frame 12, respectively.

The bracket 30 is provided on the upper end of the belt 20, connected to the conveyor belt 40 of the conveyor belt system 27. In the opened state of the overhead door 10, the bracket 30 is located on the conveyor belt 40 of the conveyor belt system 27 adjacent to the second cogwheel 29.

Figure 5:
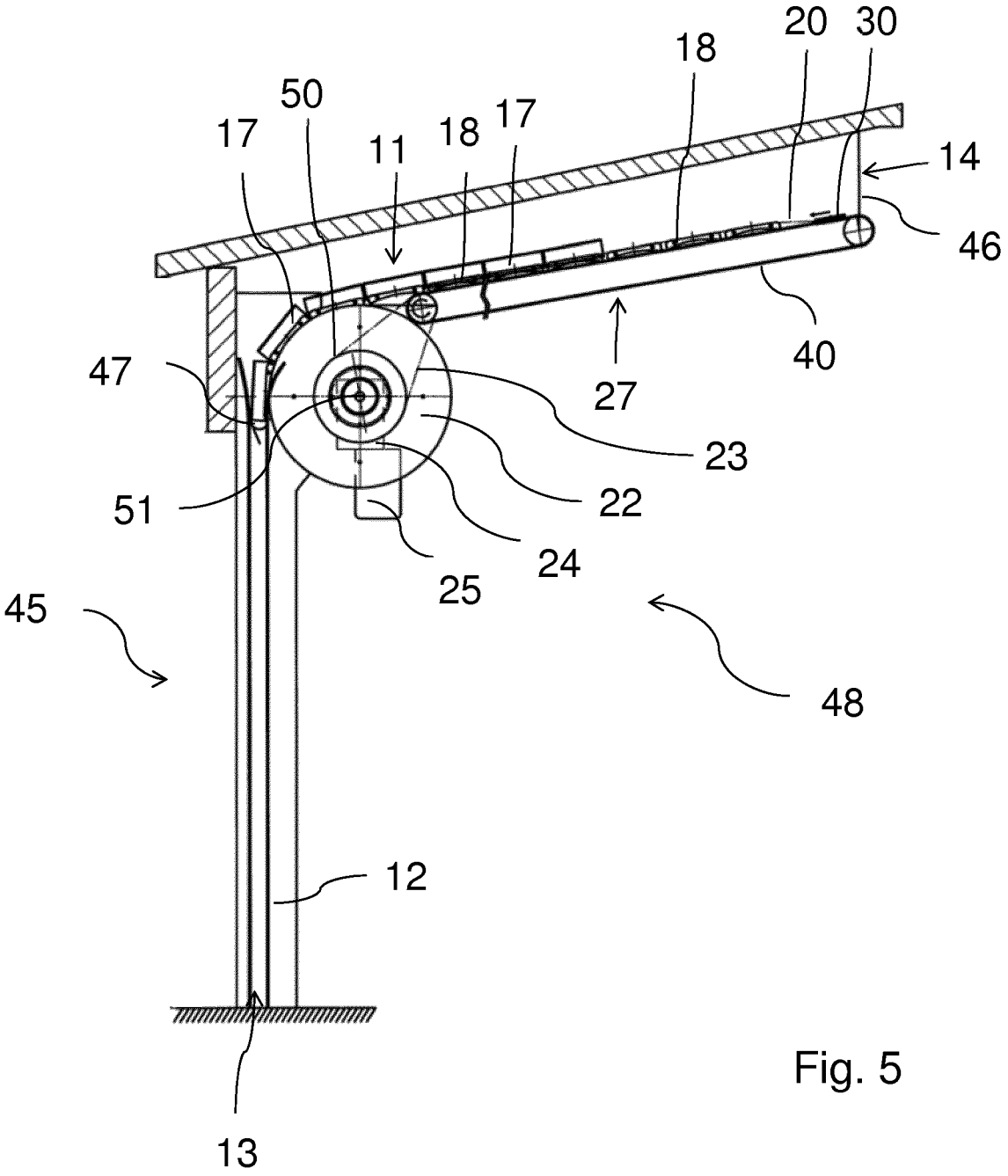

FIG. 5 shows a schematic section of a second embodiment of an overhead door 48 with the features of the invention, in an opened state. The operating principle of the overhead door 48 is comparable to those of the overhead door 10, therefore, similar objects are signed with the identical reference signs.

In this view, only the left side of the side frame 12 is visible. The door opening 45 is completely opened. The overhead door 48 only differs from the overhead door 10 in its orientation of the horizontal track 14 of the side frame 12 to the vertical track 13 of the side frame 12. In this embodiment, the horizontal track 14, extending rearward to the door blade 11, does not run perpendicular to the vertical track 13. The angle between the horizontal track 14 and the vertical track 13 is more than 90°. Thus, a back area of the horizontal track 14 is lifted up compared to a front area of the horizontal track 14, which is faced to the vertical track 13.

Figure 6:
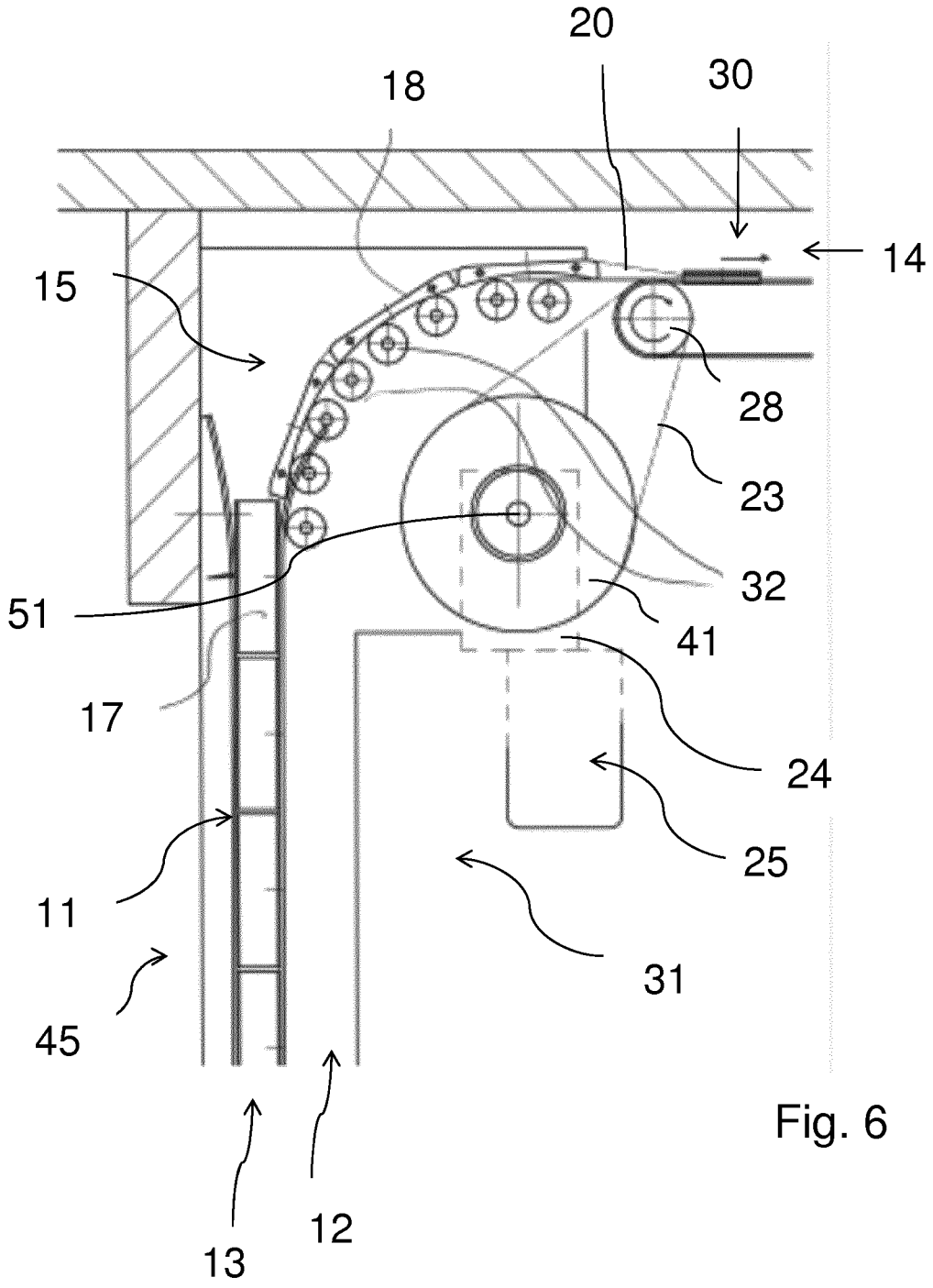

FIG. 6 shows a schematic section of a third embodiment of an overhead door 31 with the features of the invention, in a closed state. The operating principle of the overhead door 31 is comparable to those of the overhead door 10, therefore, similar objects are signed with the identical reference signs.

In this view, only the left side of the side frame 12 is visible. The door opening 45 is completely closed by the door blade 11. Thereby the door blade 11 is located between the vertical tracks 13 of the side frame 12. The vertical track 13 and the horizontal track 14 are connected by a guideway. In the shown example the guideway is represented by a plurality of wheels 32. In this example, the guideway comprises eight wheels 32. To provide a better overview, reference signs are only attached to two wheels 32. The wheels 32 are arranged in line in the connecting portion 15, following the curved shape of the connecting portion 15. The first cogwheel 28 is coupled with a gearwheel 41 by using the transmission element 23 on both sides of the side frame 12, respectively. The gearwheel 41 is driven by the motor 25.

To provide a better overview, the panels 17 are shown without end pieces 18. At the upper end of the belt 20 three additional end pieces 18 are fixed without being fitted to panels 17.

Figure 7:
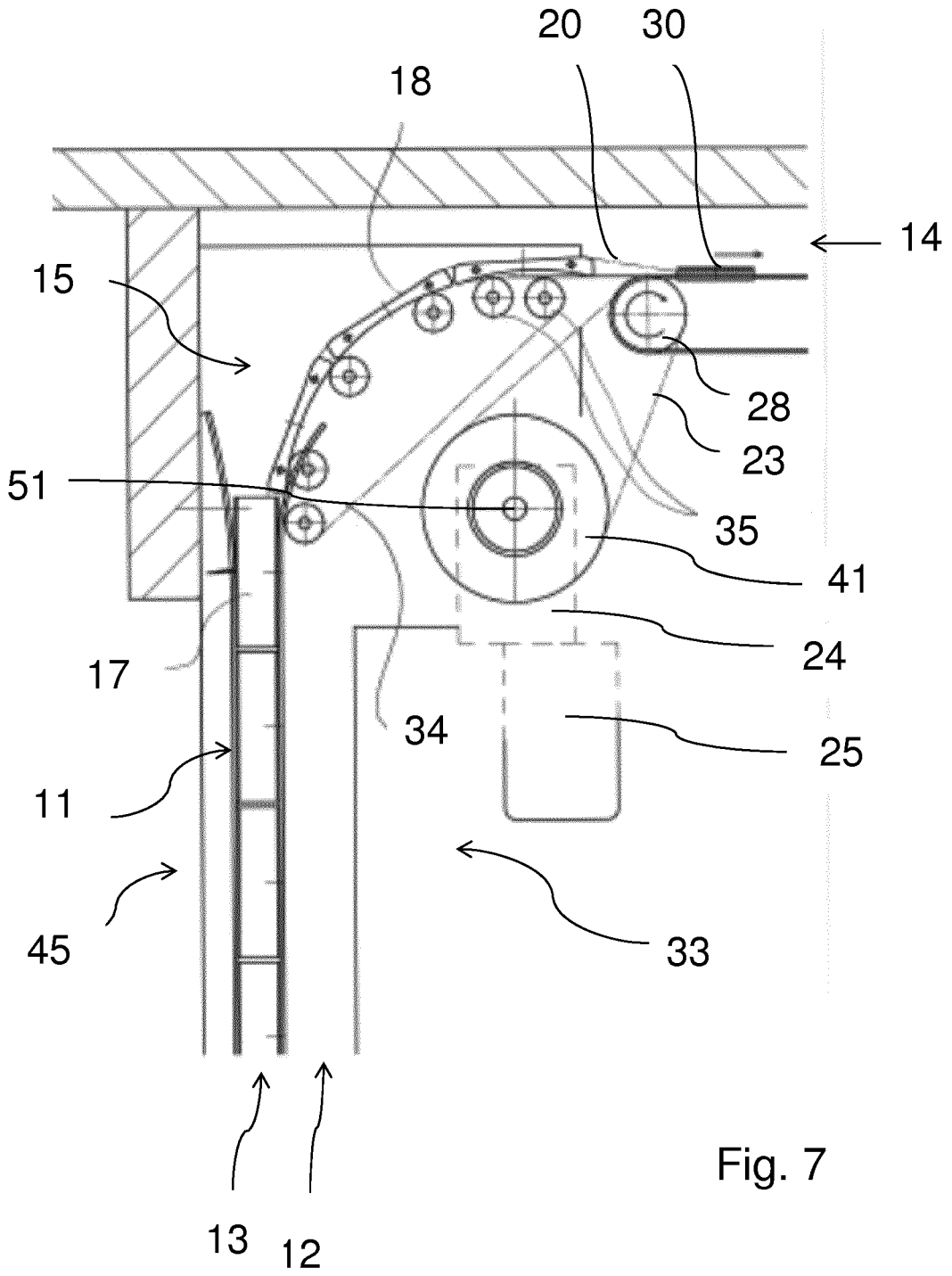

FIG. 7 shows a schematic section of a fourth embodiment of an overhead door 33 with the features of the invention, in a closed state. The operating principle of the overhead door 33 is comparable to those of the previously described overhead doors 10, 31, therefore, similar objects are signed with the identical reference signs.

In this view, only the left side of the side frame 12 is visible. The door opening 45 is completely closed by the door blade 11. Thereby the door blade 11 is located between the vertical tracks 13 of the side frame 12. The vertical track 13 and the horizontal track 14 are connected by a guideway. In the shown example the guideway is represented by a support belt 34 supported by a plurality of wheels 35. In this example, the guideway comprises six wheels 35. To provide a better overview, reference signs are only attached to two wheels 35. The wheels 35 are arranged in line in the connecting portion 15, following the curved shape of the connecting portion 15. The support belt 34 circulates the wheels 35. The first cogwheel 28 is coupled with the gearwheel 41 by using the transmission element 23 on both sides of the side frame 12, respectively. The gearwheel 41 is driven by the motor 25.

To provide a better overview, the panels 17 are shown without end pieces 18. At the upper end of the belt 20 three additional end pieces 18 are fixed without being fitted to panels 17.

Figure 8:
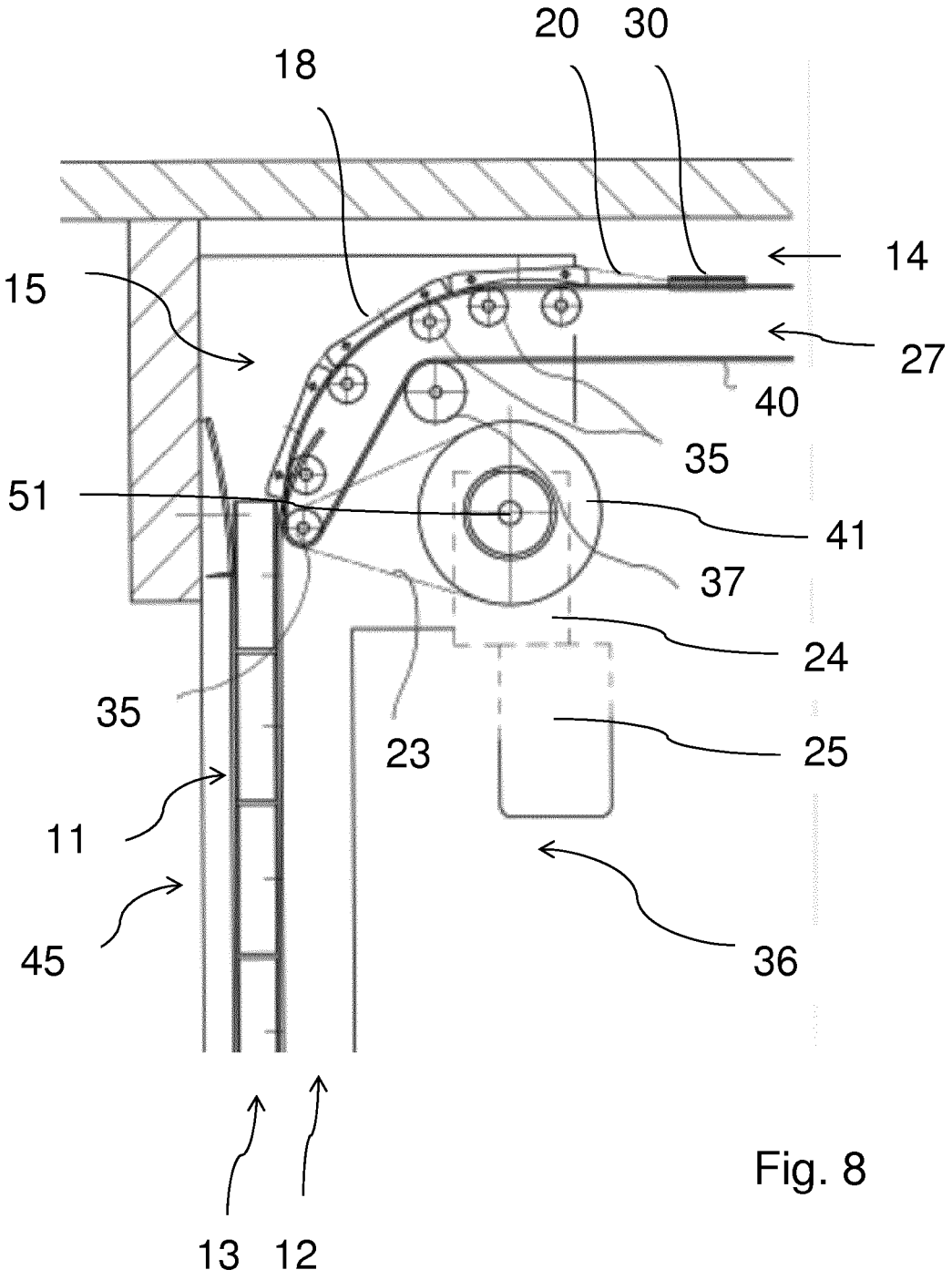

FIG. 8 shows a schematic section of a fifth embodiment of an overhead door 36 with the features of the invention, in a closed state. The operating principle of the overhead door 36 is comparable to those of the previously described overhead doors 10, 31, 33, therefore, similar objects are signed with the identical reference signs.

In this view, only the left side of the side frame 12 is visible. The door opening 45 is completely closed by the door blade 11. Thereby the door blade 11 is located between the vertical tracks 13 of the side frame 12. The vertical track 13 and the horizontal track 14 are connected by a guideway. In the shown example the conveyor belt system 27, in particular the conveyor belt 40, represents at the same time a guideway. By doing so, the conveyor belt system 27 has a plurality of wheels 35. The wheels 35 are arranged in line in the connecting portion 15, following the curved shape of the connecting portion 15. Further, the conveyor belt system 27 has a wheel 37. In the shown example, the wheel 37 differentiates from the wheel 35 in its size. In this execution example the wheel 37 is of bigger size compared to the wheels 35. Further, the wheel 37 is adjustable to tension the conveyor belt 40. The wheel 37 is located between the line of wheels 35 and the gearwheel 41. Further, the conveyor belt system 27 has a second cogwheel 29, not shown in this figure, arranged on that side of conveyor belt system 27 averted to the disc 22. In the shown example the conveyor belt system 27 do not have a first cogwheel 28. The conveyor belt 40 of the conveyor belt system 27 circulates the wheels 35, 37 and the cogwheel 29. The gearwheel 41 is coupled with one of the wheels 35 by the transmission element 23 on both sides of the side frame 12, respectively. The gearwheel 41 is driven by the motor 25.

To provide a better overview, the panels 17 are shown without end pieces 18. At the upper end of the belt 20 three additional end pieces 18 are fixed without being fitted to panels 17.

Figure 9:
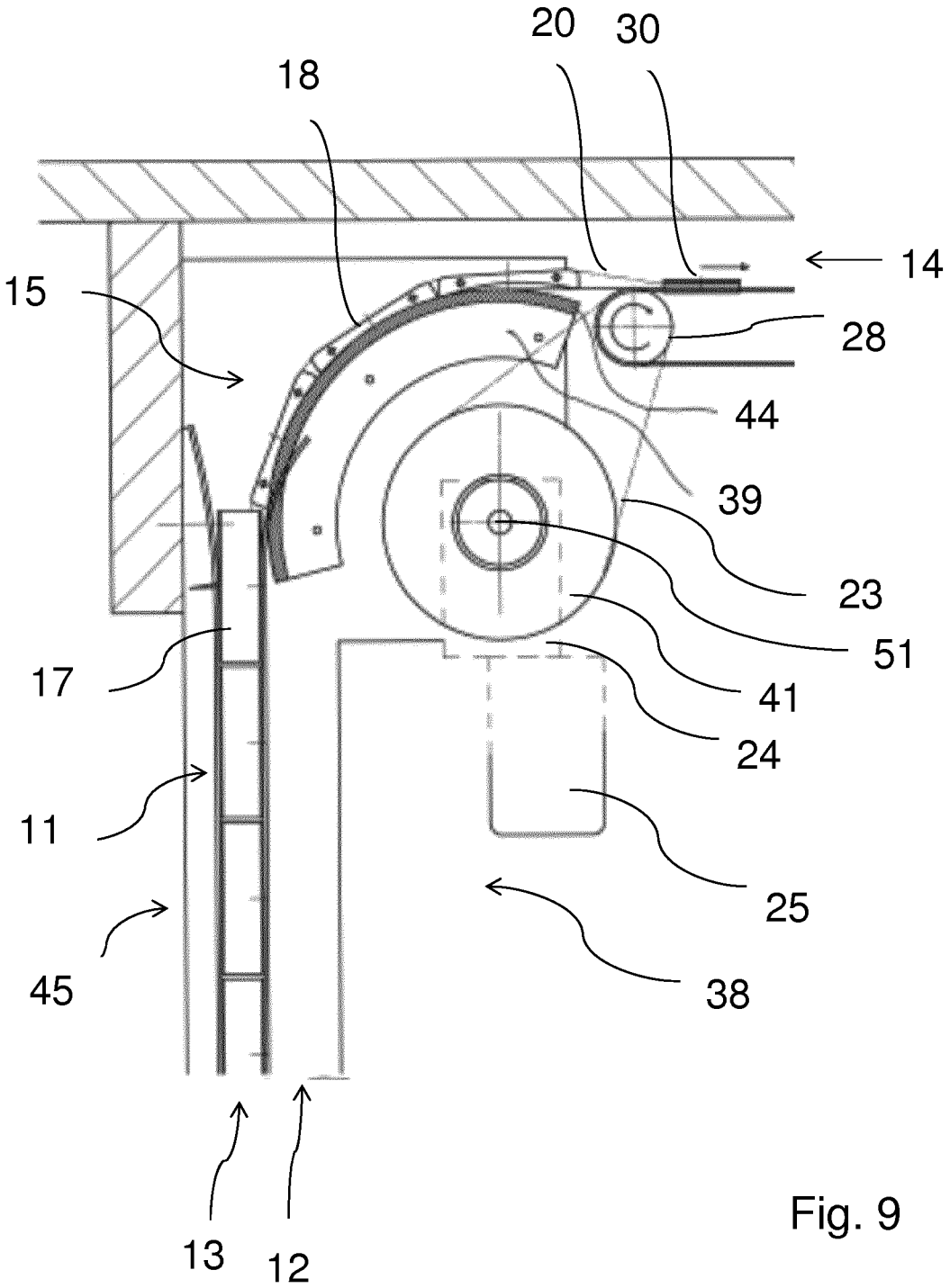

FIG. 9 shows a schematic section of another embodiment of an overhead door 38 with the features of the invention, in a closed state. The operating principle of the overhead door 38 is comparable to those of the previously described overhead doors 10, 31, 33, 36, therefore, similar objects are signed with the identical reference signs.

In this view, only the left side of the side frame 12 is visible. The door opening 45 is completely closed by the door blade 11. Thereby the door blade 11 is located between the vertical tracks 13 of the side frame 12. The vertical track 13 and the horizontal track 14 are connected by a guideway. In the shown example the guideway is represented by a curve guiding 39. The curve guiding 39 has a curved shaped adjusted to the shape of the connecting portion 15. In the shown example the curve guiding 39 consists of a rigid material. To reduce friction, in this example the sliding surface is covered with a low friction material 44. The first cogwheel 28 is coupled with the gearwheel 41 by using the transmission element 23 on both sides of the side frame 12, respectively. The gearwheel 41 is driven by the motor 25.

To provide a better overview, the panels 17 are shown without end pieces 18. At the upper end of the belt 20 three additional end pieces 18 are fixed without being fitted to panels 17.

The operating principle of the overhead door 10, 31, 33, 36, 38, 48 according to the invention will be explained hereinafter according to the FIGS. 1 to 9:

To open the overhead door 10, 31, 33, 36, 38, 48 the door blade 11 has to be pulled up from the vertical position to the horizontal position.

The gear box 24 and the motor 25 are used to turn the drum axis 51 and simultaneously the conveyor belt 40, which are arranged on both sides of the drum axis 51, respectively. The drum axis 51 and the conveyor belt 40 are coupled by the transmission element 23 and the cogwheel 28 and/or any other wheel 35, 37 of the conveyor belt systems 27 on both sides of the side frame 12, respectively. By turning the drum axis 51, the conveyor belt systems 27 are actuated. Thereby, the conveyor belt 40 of the conveyor belt systems 27 moves in the direction averted from the door blade 11. The conveyor belt 40 of the conveyor belt system 27 is coupled with the belt 20 by using a bracket 30. Thus, when the conveyor belt system 27 is actuated, both belts 20 were pulled synchronous with same speed upwards to the horizontal track 14, thereby pulling the door blade 11 upwards. Doing so, the panels 17 are guided upwards sliding in the side frame 12.

To guide the door blade 11 from the vertical track 13 to the horizontal track 14, the end pieces 18 of the panels 17 can be move around the curved connecting portion 15 by using different guideways 16:

(1) the end pieces 18 can be transported by rotatable discs 22 as shown in FIGS. 1 to 5,
(2) the end pieces 18 can be rolled over a line of wheels 32 as shown in FIG. 6,
(3) the end pieces 18 can be move over a support belt 34 supported by wheels 35 as shown in FIG. 7,
(4) the end pieces 18 can be transported by the conveyor belt 40 of the conveyor belt system 27; in this case the conveyor belt 40 runs over the wheels 35, 37 as shown in FIG. 8, or
(5) the end pieces 18 can slide over a rigid curve guiding 39 as shown in FIG. 9.

By turning the drum axis 51 in the opposite direction, the conveyor belt systems 27 transport the panels 17 the other way around from the horizontal track 14 around the curved connection portion 15 into the vertical track 13. As nearly all panels 17 are actively transported, there is no relative movement between the panels 17 and the conveyor belt 40 of the conveyor belt system 27.

REFERENCE NUMERALS

10 overhead door
11 door blade
12 side frame
13 vertical track
14 horizontal track
15 connecting portion
16 guideway
17 panel
18 end piece
19 slot
20 belt

21 drum
22 disc
23 transmission element
24 gear box
25 motor
26 blade spring
27 conveyor belt system
28 first cogwheel
29 second cogwheel
30 bracket
31 overhead door
32 wheel
33 overhead door
34 support belt
35 wheel
36 overhead door
37 wheel
38 overhead door
39 curve guiding
40 conveyor belt
41 gearwheel
42 wall
43 ceiling
44 low friction material
45 door opening
46 rear side
47 bottom sealing
48 overhead door
49 support means
50 wheel disc
51 drum axis

The invention claimed is:

1. An overhead door for covering a door opening, the overhead door comprising:

a door blade with a plurality of panels, said door blade being movable within a frame between a vertical, closed position and a horizontal, opened position;

the frame comprising a double-sided vertical track and a horizontal track connected by a connection portion and by a first belt associated with a first side of the said frame and a second belt associated with a second side of the frame configured to lift the panels from said vertical position to said horizontal position; and a driver configured to drive simultaneously the plurality of panels, wherein the driver comprises a conveyor belt system adjacent to the horizontal track, said conveyor belt system being powered by a drum and being, at least in said horizontal position of said door blade, in engagement at least partially with the door blade; and a first disc assigned to a first end of said drum and a second disc assigned to a second end of said drum.

2. The overhead door according to claim 1, wherein each panel of said plurality of panels has a height from 150 mm to 350 mm.

3. The overhead door according to claim 1, said plurality of panels is guided sliding in said frame.

4. The overhead door according to claim 1, further comprising:

a plurality of pairs of end pieces, each pair of said end pieces assigned to one of said panels with one end piece of said pair of end pieces being fitted in longitudinal direction to a first end of the one of said panels and another end piece of said pair of end pieces being fitted in the longitudinal direction to a second end of the one of said panels, wherein for each pair of end pieces, said one end piece being fitted to the first end of said panels is fixed to the first belt and said another end piece being fitted to the second end of said panels is fixed to the second belt, wherein said first belt and the second belt are constructed as flexible, flat belts.

5. The overhead door according to claim 1, wherein said drum extends parallel to said panels.

6. The overhead door according to claim 1, a first blade spring assigned in longitudinal direction to a first end of said drum and a second blade spring assigned in the longitudinal direction to a second end of said drum.

7. The overhead door according to claim 1, wherein said drum extends parallel to said panels and is arranged in a transition region between said vertical tracks and said horizontal tracks, said drum being carried by a support.

8. An overhead door for covering a door opening, the overhead door comprising:

door blade with a plurality of panels, said door blade being movable within a frame between a vertical, closed position and a horizontal, opened position;

the frame comprising a double-sided vertical track and a horizontal track connected by a connection portion and by a belt associated with one side each of the said frame and configured to lift the panels from said vertical position to said horizontal position; and a driver configured to drive simultaneously the plurality of panels, wherein the driver comprises a conveyor belt system adjacent the horizontal track, said conveyor belt system being powered by a drum and being, at least in said horizontal position of said door blade, in engagement at least partially with the door blade; and a first blade spring assigned in longitudinal direction to a first end of said drum and a second blade spring assigned in the longitudinal direction to a second end of said drum.

9. An overhead door for covering a door opening, the overhead door comprising:

a door blade with a plurality of panels, said door blade being movable within a frame between a vertical, closed position and a horizontal, opened or overhead position;

the frame comprising a double-sided vertical track and a horizontal track connected by a connection portion and by a belt associated with one side each of the said frame and configured to lift the panels from said vertical position to said horizontal position; and a driver configured to drive simultaneously the plurality of panels, wherein the driver comprises a conveyor belt system adjacent the horizontal track, said conveyor belt system being, at least in said horizontal position of said door blade, in engagement at least partially with the door blade, and said conveyor belt system comprising at least one cogwheel, a conveyor belt, a chain and a plurality of wheels.

10. The overhead door according to claim 9, further comprising a bracket coupling said conveyor belt of said conveyor belt system with an upper end of said belt.

11. The overhead door according to claim 9, wherein said door blade is guided above said conveyor belt of said conveyor belt system.

12. The overhead door according to claim 9, further comprising a transmission element coupling said cogwheel or any of said other wheels of said conveyor belt system, with a drum or a disc.

13. The overhead door according to claim 9, further comprising a drum, and a motor coupled to said drum or said cogwheels or any of said other wheels of the conveyor belt system.

14. The overhead door according to claim 9, said conveyor belt system being powered by a drum, a first disc assigned to a first end of said drum and a second disc assigned to a second end of said drum.

15. The overhead door according to claim 9, said conveyor belt system being powered by a drum, a first blade spring assigned in longitudinal direction to a first end of said drum and a second blade spring assigned in the longitudinal direction to a second end of said drum.

16. The overhead door according to claim 9, further comprising a transmission element coupling said cogwheel with a drum or with a disc.

17. An overhead door for covering a door opening, the overhead door comprising:

a door blade with a plurality of panels, said door blade being movable within a frame between a vertical, closed position and a horizontal, opened or overhead position;

the frame comprising a double-sided vertical track and a horizontal track connected by a connection portion and by a belt associated with one side each of the said frame and configured to lift the panels from said vertical position to said horizontal position; and a driver configured to drive simultaneously the plurality of panels, said connection portion comprising a guideway with a disc, at least one wheel, a support belt and a curve guiding.

* * * * *